US005108244A

United States Patent [19]

Bellanca

[11] Patent Number: 5,108,244

[45] Date of Patent: Apr. 28, 1992

[54] BOOK PRODUCTION PROCESS AND APPARATUS

[75] Inventor: Joseph V. Bellanca, Sarasota, Fla.

[73] Assignee: Kolbus GmbH & Co., KG, Rahden, Fed. Rep. of Germany

[21] Appl. No.: 747,880

[22] Filed: Aug. 20, 1991

[51] Int. Cl.[5] ..... B42C 9/00

[52] U.S. Cl. ..... 412/37; 412/16

[58] Field of Search ..... 412/16, 37, 900; 281/15.1, 21.1

[56] References Cited

U.S. PATENT DOCUMENTS 3,179,967 4/1965 Yohn et al. ..... 412/16

3,594,837 7/1971 French ..... 412/37 X

*Primary Examiner*—Paul A. Bell

*Attorney, Agent, or Firm*—Chilton, Alix & Van Kirk

[57] ABSTRACT

In the application of a cover to a book block, a woven cloth strip is adhesively bonded to a flyleaf and an end-paper along generally parallel, displaced lines which extend from the top to the bottom of the book. The flyleaf may be stapled to the book block along with the cloth strip and the end-paper is glued to both the cover and the cloth strip.

18 Claims, 4 Drawing Sheets

BOOK PRODUCTION PROCESS AND APPARATUS

BACKGROUND OF THE INVENTION

1. Field of the Invention

The present invention relates to the production of books and particularly to the application of covers to book blocks. More specifically, this invention is directed to apparatus for completing the assembly of a book by applying a casing to a book block, the book block comprising a stack of individual printed sheets of paper, and especially to apparatus for adhesively joining a cover to a book block. Accordingly, the general objects of the present invention are to provide novel and improved methods and apparatus of such character.

2. Description of the Prior Art

In the manufacture of books, it is known to join each of the front and rear covers to a book block via a so-called "flyleaf" on the book block and an end-paper on the book cover inner surface. In the manufacture of books which embody a flyleaf, use is made of special end-paper sheets which are folded to define two leaves. The leaves of each of these end-paper sheets are interconnected, at a pair of generally parallel ends thereof disposed oppositely with respect to the fold line by a woven cloth strip. Thus, a separate woven cloth strip is adhesively secured to each flyleaf and its associated end-paper sheet. This provides a construction wherein a cover joint region, defined in part by a cloth strip, is visible when either cover is opened.

The above-discussed folded or double end-paper sheets must be formed in a separate specialized operation After these special end-paper sheets have been formed and put in place, the placement and joining of the leaves of the double end-paper sheets occurring at the first and last stations of a book assembly machine, the book block back is milled. Subsequently, if necessary, the book block is side-stapled. All of these operations are typically performed in an adhesive-binding machine. The above-mentioned steps are followed by three-side trimming and, finally, casing the book block by adhesively securing the cover thereto.

Continuing to discuss the prior art book casing operation, the trimming of the book block, held together by wire staples for example, results in the removal of the rear edge of each of the folded-over end-paper sheets, i.e., the edge defined by the fold line. Accordingly, two separate sheets are formed. These separate sheets will, at both the front and the back of the book, be interconnected by a woven cloth strip. The outermost of these sheets, i.e., the end-papers, and their associated cloth strips are adhesively secured to an inner surface of a cover in the completed book.

The prior art book casing procedure as briefly described above, while producing an acceptable product, is characterized by inefficiency. This inefficiency, to some degree, results from the fact that the process requires the formation of special end-paper sheets in a separate production facility and independently of the remainder of the book production process. Further, there has long been a desire for a construction technique which would provide a book having increased resistance to wear and tear.

SUMMARY OF THE INVENTION

The present invention overcomes the above-discussed and other deficiencies and disadvantages of the prior art by providing a novel and improved process for the production of books and by providing apparatus for use in the implementation of this process. The process of the present invention allows books to be produced, and particularly permits covers to be applied to book blocks, in an uninterrupted manner. Further, the process of the present invention produces a product, namely a book, of enhanced durability and, particularly, a book characterized by improved resistance to wear and tear when compared to the prior art.

Apparatus in accordance with the present invention includes means for stacking, with continuously moving book blocks, a pair of oppositely disposed end-paper sheets. These end-paper sheets are folded such that they each define a pair of pages or leaves of unequal size but having parallel edges, these edges facing in the same direction as the back surface of the book block. As the book blocks with the end-paper sheets continue to move through the apparatus, an adhesive is applied to the back surface of the book block. Stripes of the adhesive are also deposited on a pair of outwardly facing, parallel, offset edge areas of the two leaves of each end-paper sheet. This adhesive application leaves a glue-free zone, which extends from the top to the bottom of the book block, between the two stripes of adhesive. A single woven cloth interconnection strip is thereafter applied and, if necessary, the book block is side stapled with the staples extending through the cloth strip and the inner leaves only of the end-papers. It is to be noted that, as an alternative, the glue stripes may be applied to the woven cloth strip. In either case, the inwardly and outwardly disposed leaves of both of the folded-over end-papers will be adhesively secured, along the entire length of the book block, to a single woven cloth strip which extends from one side of the block to the other about the back of the block As the book block continues to move through the apparatus, the cover is mated with the book block and adhesively secured thereto.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENTS

Figure 1A:
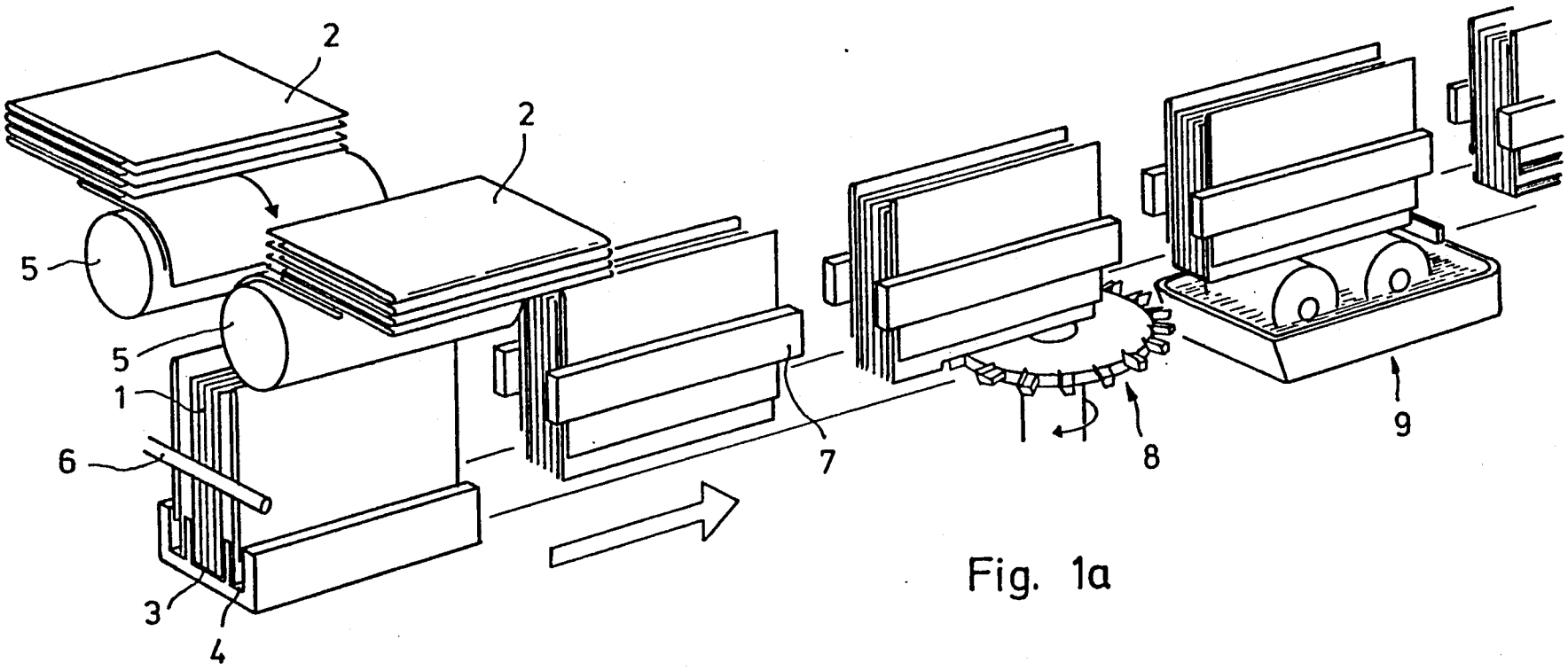
FIGS. 1*a*–1*c* comprise a schematic perspective view of a book production apparatus in accordance with the present invention, FIGS. 1*a*–1*c* also depicting a first embodiment of the process of the present invention.

With reference now to the drawings, apparatus in accordance with the present invention is represented in FIG. 1. This apparatus, which may be considered a portion of a book production line, receives a previously assembled book block 1 and applies a cover 18 thereto In the course of casing the book block, the apparatus depicted in the drawings utilizes side-stapling to ensure that the individual sheets of paper which form the book block will be held together. The finished book resulting from practice of the invention using the disclosed apparatus has inner end-papers on each side of the book block and cooperating outer end papers on the oppositely facing inside surfaces of the front and rear covers. All of these end-papers are interconnected by a single woven cloth strip The staples which hold the book block together in the disclosed embodiment will extend through the cloth strip The cloth strip is adhesively secured to both inner and both outer end papers as well as being adhesively secured to the inner surfaces of the front and rear covers. The outer end-papers, which are also adhesively secured to the book cover inner surfaces, overlap the woven cloth strip only along edge areas thereof with the result that the cloth strip will be exposed in the hinge joint regions when the book cover is opened.

As will become obvious to those skilled in the art from the discussion below, the present invention permits the production of books of the type generally described in the immediately preceding paragraph in an uninterrupted process flow. Restated, the sequence of operations which comprise the invention, and the choice of apparatus for use in performing the various operational steps, permits the book casing procedure of the present invention to be performed in a continuous, and thus exceedingly efficient, manner.

The apparatus of the present invention receives the book blocks 1, consisting of stacks of individual printed sheets, from a block assembling machine, not shown. As received, the book blocks 1 are oriented in an upright position with the back of the block facing downwardly. The book blocks enter a transfer channel which defines a support surface 3 Folded-over end-paper sheets 2, with the fold lines thereof pointed upwardly, i.e., in a direction opposite to that in which the book block back is facing, are delivered into registration with the opposite sides of the book block. The end-paper sheets 2 each have an outer leaf 2*a* and an inner leaf 2*b*. As may be seen from FIG. 7, the sheets 2 are folded such that the outer leaf 2*a* is smaller than the inner leaf 2*b*. Feed devices 6 deposit the sheets 2, with the edges of the leaves which are disposed opposite the fold line facing downwardly, in a pair of U-shaped channels 4 When located in the channels 4, the end-paper sheets 2 will be oriented parallelly with respect to the printed sheets which comprise the book block 1 and the inner leaves 2*b* of the two end-paper sheets will respectively be adjacent the first and last sheets of the block.

Figure 1B:
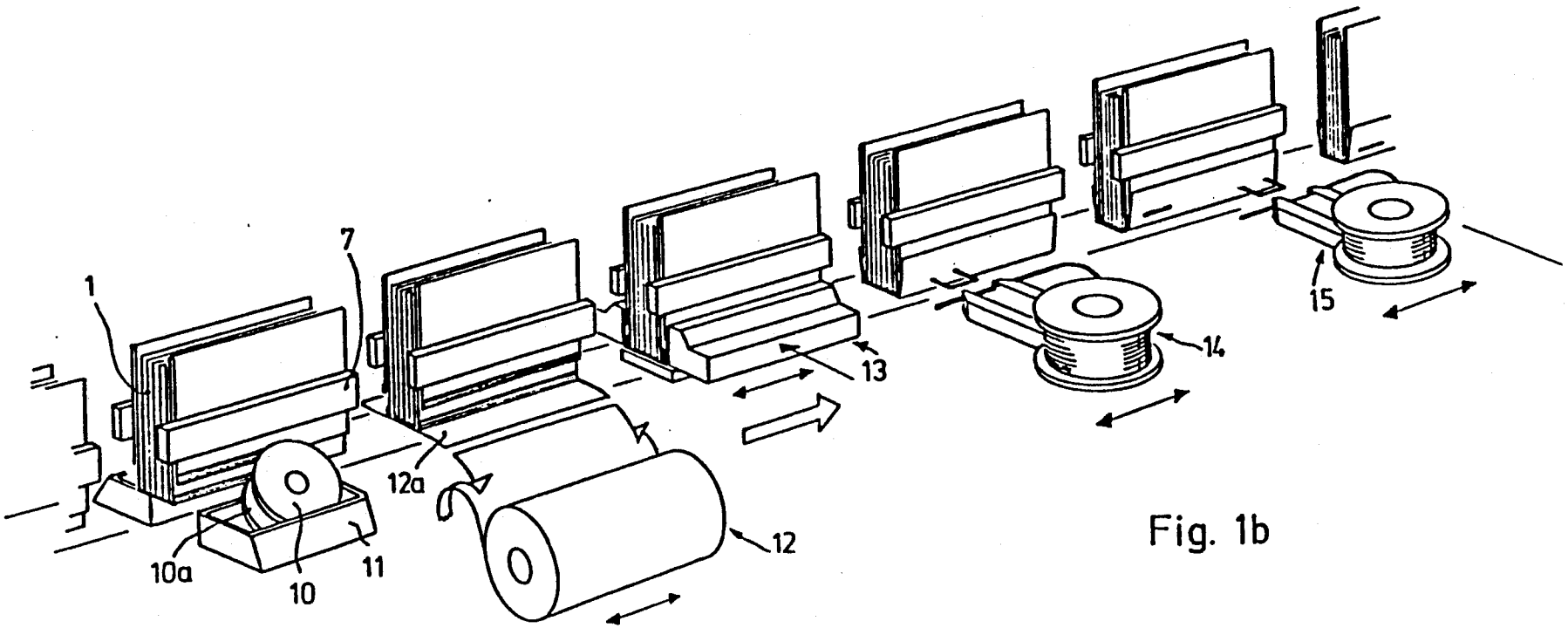

The book block 1 and the end-paper sheets 2 are pushed forwardly, by means of pusher elements 6, in the direction indicated by the arrow on FIG. 1*a*. As they move forwardly, the book blocks and end-paper sheets will be acquired by clamps 7. Prior to the time they are acquired by the clamps 7, the book blocks and end-paper sheets 2 are laterally supported. After being acquired by the clamps 7, each book block 1 with its associated pair of oppositely disposed end-paper sheets 2 will pass through a milling station where a mechanical milling device 8 mills the back of the book block.

After milling, and while still held by the clamps 7, the book block will pass through an adhesive application station which is indicated generally at 9 In the adhesive application station 9 a film of glue is applied to the back surface of the book block.

Figure 7:
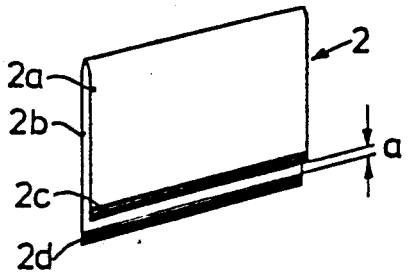
FIG. 7 is a perspective view depicting an end-paper sheet to which displaced parallel stripes of adhesive have been applied in the course of practice of the present invention.

After the glue has been applied to the book block back, the block 1 will pass through a second adhesive application station wherein a pair of stripes of glue, indicated at 2*c* and 2*d* in FIG. 7, are respectively applied to the outer leaf 2*a* and inner leaf 2*b* of each of the end-paper sheets 2 in regions adjacent the parallel edges. In the embodiment depicted in FIG. 1, the second adhesive applying station comprises a pair of truncated, circular-conical discs 10, 10*a* located on each side of the book block. The discs 10, 10*a*, which can also be seen from FIG. 2, are mounted on a common drive shaft. The discs 10, 10*a* are inclined, are spaced one from the other and are arranged to contact the contents of a glue reservoir 11 As the clamped book blocks and end-paper sheets move through the second adhesive application station, and the parallel stripes 2*c* and 2*d* of glue are deposited on the leaves of the end-paper sheets in the manner represented in FIG. 2, a glue-free interval "a" is maintained between the stripes as shown in FIG. 7.

After passing through the two adhesive application stations, the clamped book block will arrive at a "hinge-fitting" station 12. As indicated by the double ended arrow on FIG. 1*b*, the hinge-fitting station 12 moves in synchronism with the moving book block. At the hinge-fitting station 12, a woven cloth strip 12*a* is cut from a supply roll and applied over the coating of glue on the end of the book block.

The next step in the production of a book in accordance with the present invention is to fold and press, at a pressing station 13, the cloth strip 12*a* against the book block back and also against the edge areas of the end-papers to which the glue stripes 2*c* and 2*d* have been applied. The folding/pressing apparatus, as indicated by double ended arrow on FIG. 1*b*, also moves in synchronism with the continuously moving book block and thus the pressing apparatus must be capable of reciprocal motion along the book block transport path.

In the disclosed embodiment, as the process continues, the book block 1, backed by the hinge cloth 12*a* and still held in the clamps 7, is subjected to a side-stapling operation. The side-stapling operation is performed, in the disclosed embodiment, by means of a pair of stapling heads 14, 15 which are arranged sequentially along the book block transport path and are also movable in synchronism with the book block.

Figure 1C:
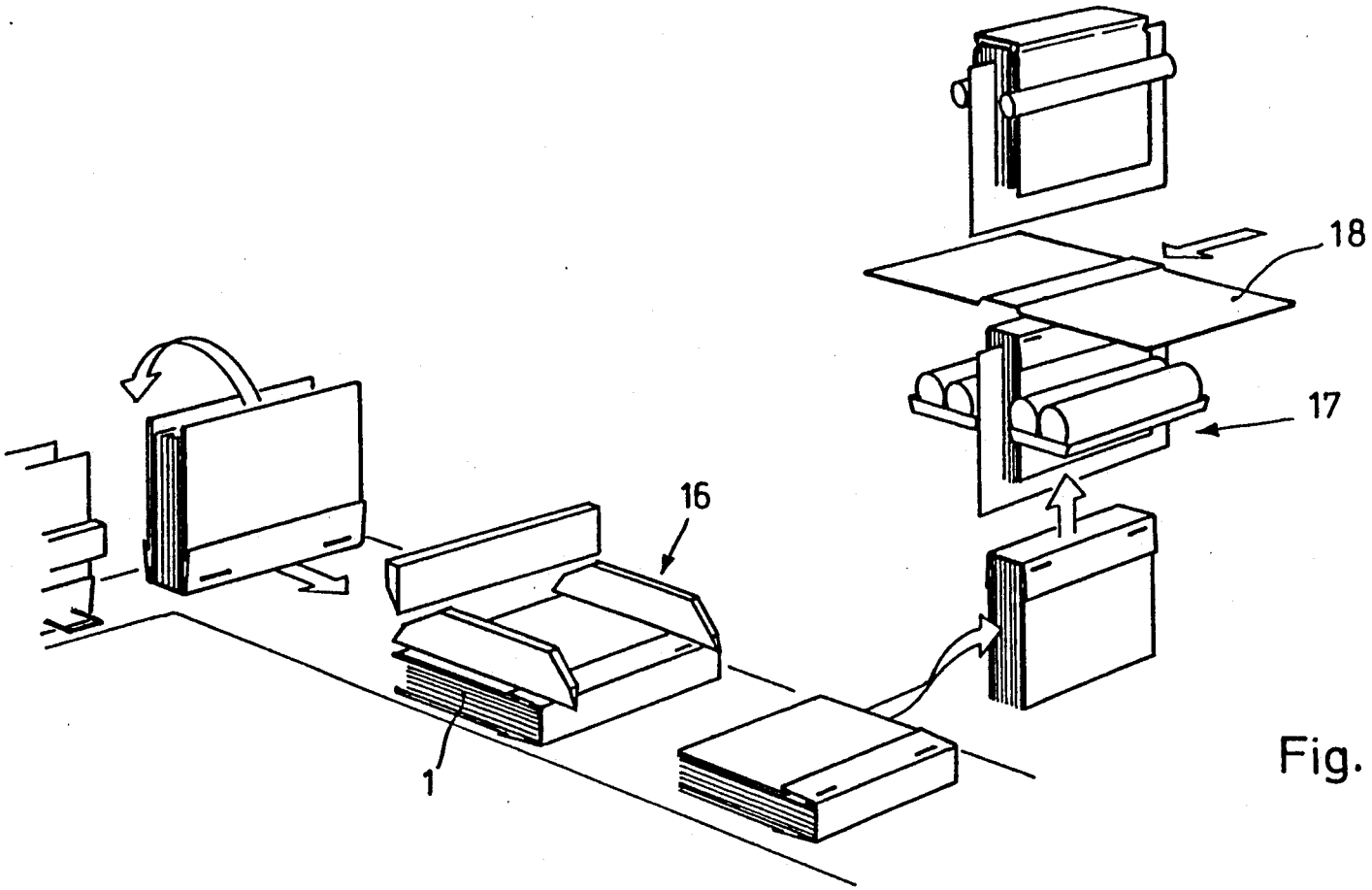
Figure 2:
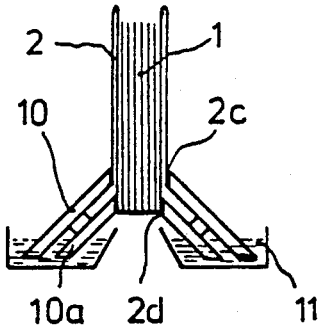
FIG. 2 is a schematic front elevational view of a portion of the apparatus of FIG. 1.
Figure 8:
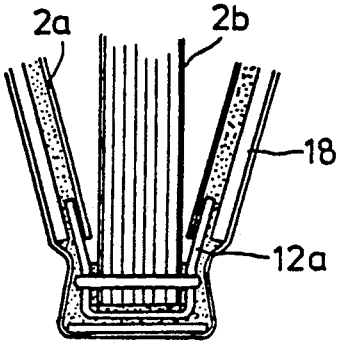
FIG. 8 is a diagrammatic cross-sectional view of a book produced in accordance with the present invention.

Referring to FIG. 1*c*, after the side-stapled book block 1 has emerged from the above-described adhesive binding apparatus, it is trimmed on three sides in a trimming station 16. This trimming operation is performed in the known manner and results in the removal of the folded edges of the end-paper sheets 2 so that two separate end-papers 2*a*', and 2*b*', are formed As previously described, the edges of these separated end-papers 2*a*', 2*b*', are, at the sides thereof which face the book block back, vertically offset with respect to each other and are interconnected by the woven cloth strip 12*a*. This relationship may be seen from FIG. 8. FIG. 8 also shows that the staples will extend through the woven cloth strip 12*a* and the two oppositely disposed inner end-papers 2*b*'.

After emerging from the trimming station 16, the book block is delivered to a book casing apparatus 17 in which glue is applied to the side surfaces of the book block, i.e., to the outwardly disposed sides of the outer end-papers 2*a*'. The glue may also be applied to the exposed outer surface areas of the woven cloth strip 12*a*. This application of glue is followed by the mating of the book block with the book cover 18.

Figure 3:
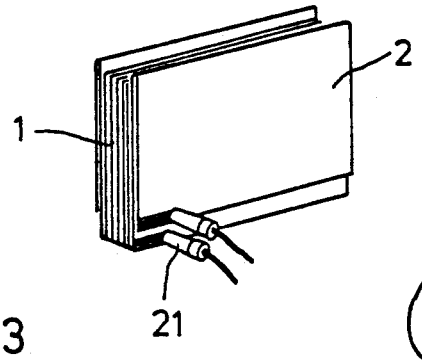
FIGS. 3–6 are schematic perspective views showing four different alternatives to the apparatus of FIG. 2.
Figure 4:
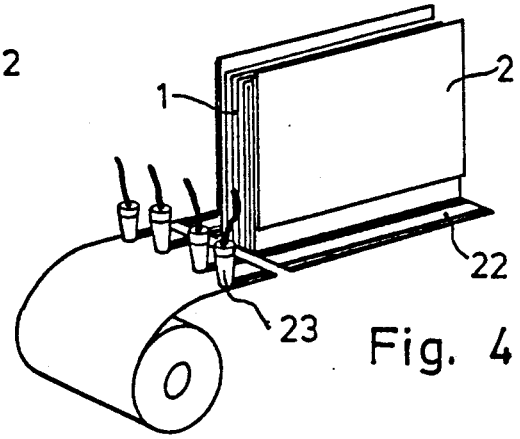
Figure 5:
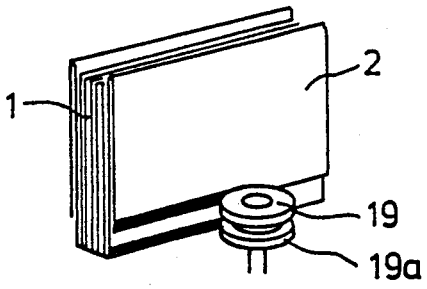
Figure 6:
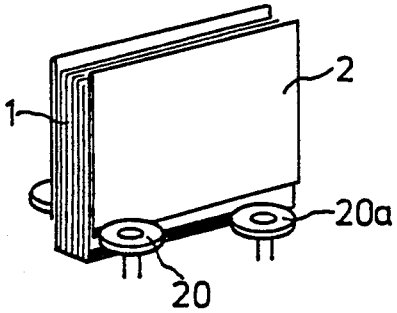

The gluing of the woven cloth strip 12*a* to the end-paper sheets 2 along displaced parallel lines or stripes can be accomplished in several ways in accordance with the invention. For example, as shown in FIG. 5, it is possible to employ cylindrical glue-application discs 19, 19*a* rather than the truncated discs 10, 10*a* described above. Also, as depicted in FIG. 6, the glue application discs 20, 20*a* may be offset from one another in the direction of book block travel Yet another alternative, depicted in FIG. 3, is the use of pairs of nozzles 21 to form the stripes of glue. Additionally, as shown in FIG. 4 wherein glue application nozzles 23 are depicted, the spaced stripes of glue could be applied to the woven cloth strip (indicated at 22 in FIG. 4), rather than being applied to the end-paper sheets, prior to mating the woven cloth strip to the book block.

While preferred embodiments have been shown and described, various modifications and substitutions may be made thereto without departing from the spirit and scope of the invention. Accordingly, it is to be understood that the present invention, which provides an efficient way to produce a high quality product as depicted in application FIG. 8, has been described by way of illustration and not limitation.

What is claimed is:

1. A method for producing a book, the book comprising a book block cased in a book cover, the book block consisting of a stack of sheets of paper, the book block being joined to the book cover by means of a woven cloth strip which connects an inner end-paper on the block with an outer end-paper on the cover, said method comprising the steps of:

delivering a pair of folded-over end-paper sheets into registration with a moving book block, the end-paper sheets being respectively disposed on opposite sides of the block, the folded-over end-paper sheets each defining a pair of leaves of unequal size, said leaves having displaced generally parallel edges disposed oppositely with respect to the fold lines of said sheets, said displaced edges facing in the same direction as the back of the book block;

clamping the end-paper sheets to the moving book block;

coating at least a portion of the back surface of the moving book block with an adhesive;

forming a pair of generally parallel stripes of adhesive on each end-paper sheet, the stripes of adhesive being deposited in regions adjacent said displaced parallel edges whereby adhesive-free intervals extending from the top to the bottom of the book block are defined between the stripes;

applying a woven cloth strip to the book block back, the cloth strip having a width which exceeds the thickness of the book block;

folding the cloth strip around the edges of the book block back whereby the cloth strip overlays the stripes of adhesive on the oppositely disposed end-paper sheets and the cloth strip will be adhesively secured to the back of the book block and both leaves of each of said end-paper sheets;

trimming the book block, the trimming separating the leaves of the end-paper sheets into inner and outer end-paper sheets; and affixing a cover to the book block, the cover abutting the outer end-paper sheets and being adhesively secured to at least the said outer end-paper sheets.

2. The method of claim 1 further comprising the step of:

stapling the cloth strip to the book block and the inner end-paper sheets.

3. The method of claim 1 further comprising the step of:

milling the back of the book block to a predetermined size and shape after clamping the end-paper sheets thereto.

4. The method of claim 3 further comprising the step of:

stapling the cloth strip to the book block and the inner end-paper sheets.

5. A method for producing a book, the book comprising a book block cased in a book cover, the book block consisting of a stack of sheets of paper, the book block being joined to the book cover by means of a woven cloth strip which connects an inner end-paper on the block with an outer end-paper on the cover, said method comprising the steps of:

delivering a pair of folded-over end-paper sheets into registration with a moving book block, the end-paper sheets being respectively disposed on opposite sides of the block, the folded-over end-paper sheets each defining a pair of leaves of unequal size, said leaves having displaced generally parallel edges disposed oppositely with respect to the fold lines of said sheets, said displaced edges facing in the same direction as the back of the book block;

clamping the end-paper sheets to the moving book block;

coating at least a portion of the back surface of the moving book block with an adhesive;

forming two pairs of generally parallel stripes of adhesive on a woven cloth strip, the cloth strip having a width which exceeds the thickness of the book block, the stripes of adhesive being deposited so as to define a pair of adhesive-free intervals having a width commensurate with the spacing between said leaf edges;

applying the woven cloth strip to the book block back;

folding the cloth strip around the edges of the book block back whereby the stripes of adhesive of each pair of stripes will respectively contact one of said leaves of an end-paper sheet in a region adjacent the said edge thereof and the cloth strip will be adhesively secured to the back of the book block and both leaves of each of said end-paper sheets;

trimming the book block, the trimming separating the leaves of the end-paper sheets into inner and outer end-paper sheets; and affixing a cover to the book block, the cover abutting the outer end-paper sheets and being adhesively secured to at least the said outer end-paper sheets.

6. The apparatus of claim 5 wherein said means for applying stripes of adhesive comprises:

a pair of nozzles positioned on each side of the path of movement of the book block.

7. The apparatus of claim 6 further comprising:

means for stapling said cloth strip to the book block and said inner end papers.

8. Apparatus for applying a cover to a book block, the book block consisting of a stack of sheets of paper, the book block being joined to the book cover by means of a woven cloth strip which connects an inner end-paper on the block with an outer end-paper on the cover, said apparatus comprising:

means for placing a pair of folded end-paper sheets in registration with a moving book block, said end-paper sheets placing means delivering an end-paper sheets to each of the opposite sides of the book block, the end-paper sheets each defining a pair of leaves of unequal size, said leaves having displaced generally parallel edges disposed oppositely with respect to the fold line of its sheet, the end-paper sheets being placed in registration with the book block with the displaced leaf edges facing in the same direction as the back surface of the book block;

clamping means for engaging the book block and registered end-paper sheets and moving said block and sheets together along a predetermined path;

means for adhesively coating at least a portion of the back surface of the book block as it is moved along the said path by said clamping means;

means for applying a pair of generally parallel stripes of adhesive to each of the end-paper sheets during continued movement of the clamped book block along said path, said adhesive applying means depositing said stripes of adhesive on said end-paper sheets in regions adjacent the said displaced parallel leaf edges whereby an adhesive-free interval is defined between the stripes;

means for applying a woven cloth strip to the adhesively coated back surface of the book block, said cloth strip having a width which is greater than the thickness of the book block, said cloth strip applying means folding the cloth strip about the edges of the book block whereby the cloth strip will overlay the stripes of adhesive on the oppositely disposed end-paper sheets;

cutting means for trimming the book block, said cutting means separating the leaves of the end-paper sheets into inner and outer end-papers; and means for adhesively affixing a cover to the book block, the cover abutting the outer end-paper sheets and being adhesively secured to at least said outer end-papers.

9. The apparatus of claim 8 wherein said means for applying stripes of adhesive comprises:

a pair of adhesive-application discs positioned on each side of the path of movement of the book block, the discs of each pair being spaced apart in a first direction by a distance commensurate with the width, of said adhesive-free interval.

The apparatus of claim 9 wherein said discs each have a truncated conical shape with the axes of the cones being inclined with respect to the path of movement of the book block.

10. The apparatus of claim 9 wherein said discs of each pair of discs are spaced apart in a second direction, said second direction being the direction of movement of the book block along said path.

11. The apparatus of claim 10 wherein said discs of each pair are mounted for rotation about a common axis.

12. The apparatus of claim 9 further comprising:

means for stapling said cloth strip too the book block and said inner end papers.

13. The apparatus of claim 9 wherein said discs of each pair of discs are spaced apart in a second direction, said second direction being the direction of movement of the book block along said path.

14. The apparatus of claim 9 wherein said discs of each pair are mounted for rotation about a common axis.

15. The apparatus of claim 8 further comprising:

means for stapling said cloth strip to the book block and said inner end papers.

16. Apparatus for applying a cover to a book block, the book block consisting of a stack of sheets of paper, the book block being joined to the book cover by means of a woven cloth strip which connects an inner end-paper on the block with an outer end-paper on the cover, said apparatus comprising:

means for placing a pair of folded-over end-paper sheets in registration with a moving book block, said end-paper sheet placing means delivering an end-paper sheets to each of the opposite sides of the book block, the folded end-paper sheets each defining a pair of leaves of unequal size, said leaves having displaced generally parallel edges disposed oppositely with respect to the fold line of the associated end-paper sheet, the end-paper sheets being placed in registration with the book block with the displaced leaf edges facing in the same direction as the back surface of the book block;

clamping means for engaging the book block and registered end-paper sheets and moving said block and sheets together along a predetermined path;

means for adhesively coating at least a portion of the back surface of the book block as it is moved along the said path;

means for applying two pairs of generally parallel stripes of adhesive to a woven cloth strip, an adhesive-free interval having a width which is defined between the stripes of each pair, said intervals being commensurate with the space between said leaf edges;

means for applying said woven cloth strip to the adhesively coated back surface of the book block, said cloth strip applying means folding the cloth strip about the edges of the book block whereby the cloth strip will be adhesively secured to the book block and to both leaves of each of said oppositely disposed end-paper sheets;

cutting means for trimming the book block, said cutting means separating the leaves of the end-paper sheets into inner and outer end-papers; and means for adhesively affixing a cover to the book block, the cover abutting the outer end-papers and being adhesively secured to at least said outer end papers.

17. The apparatus of claim 16 further comprising:

means for stapling said cloth strip to the book block and said inner end papers.

18. The apparatus of claim 16, wherein said means for applying parallel stripes of adhesive comprises glue-application nozzles positioned corresponding to the said displaced parallel edges of said leaves, and wherein said means for applying the cloth strip deliver said strip in a direction which is lengthwise with respect to the orientation of the book block.

* * * * *

UNITED STATES PATENT AND TRADEMARK OFFICE

CERTIFICATE OF CORRECTION

PATENT NO. : 5,108,244

DATED : April 28, 1992

INVENTOR(S) : Joseph V. Bellanca

It is certified that error appears in the above-identified patent and that said Letters Patent is hereby corrected as shown below:

Column 6, line 59, change "5" to --8--.

Column 7, line 7, change "sheets" to --sheet--; line 52, before "The" insert --10.--; lines 56 through 59 should be deleted.

Column 7, line 64, change "too" to --to--.

Signed and Sealed this

Seventh Day of June, 1994

*Attest:*

Bruce Lehman

BRUCE LEHMAN

*Attesting Officer*

*Commissioner of Patents and Trademarks*